US009605671B2

(12) United States Patent
Nagura et al.

(10) Patent No.: US 9,605,671 B2
(45) Date of Patent: Mar. 28, 2017

(54) RECIPROCATING COMPRESSOR

(71) Applicant: Kabushiki Kaisha Kobe Seiko Sho (Kobe Steel, Ltd.), Kobe-shi (JP)

(72) Inventors: Kenji Nagura, Takasago (JP); Toshio Hirai, Takasago (JP); Hitoshi Takagi, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 249 days.

(21) Appl. No.: 14/218,095

(22) Filed: Mar. 18, 2014

(65) Prior Publication Data

US 2014/0322043 A1 Oct. 30, 2014

(30) Foreign Application Priority Data

Apr. 26, 2013 (JP) ..... 2013-093836

(51) Int. Cl.
*F04B 53/16* (2006.01)
*F04B 53/02* (2006.01)
(Continued)

(52) U.S. Cl.
CPC ..... *F04B 53/02* (2013.01); *F04B 35/01* (2013.01); *F04B 39/0005* (2013.01); *F04B 39/0022* (2013.01); *F04B 39/122* (2013.01); *F04B 39/125* (2013.01); *F04B 39/126* (2013.01); *F04B 53/164* (2013.01)

(58) Field of Classification Search
CPC ..... F04B 53/164
See application file for complete search history.

(56) References Cited

U.S. PATENT DOCUMENTS 2,204,374 A * 6/1940 Metzgar ..... F04B 39/041 277/349
3,469,855 A 9/1969 Enting
(Continued)

FOREIGN PATENT DOCUMENTS

EP 2 410 180 A1 1/2012
JP H01-125870 8/1989
(Continued)

OTHER PUBLICATIONS

Extended European Search Report issued Oct. 13, 2014 in Patent Application No. 14159015.8.

*Primary Examiner* — F. Daniel Lopez
(74) *Attorney, Agent, or Firm* — Oblon, McClelland, Maier & Neustadt, L.L.P.

(57) ABSTRACT

The present invention provides a reciprocating compressor that compresses a gas, including: a piston; a cylinder that includes a hole portion into which the piston is inserted so as to be movable in the axial direction in a reciprocating manner and includes a compression chamber which is formed in an area of the hole portion near a front end of the piston so that a gas is introduced into the compression chamber; a crank mechanism that drives the piston so that the gas introduced into the compression chamber is compressed by the piston; and a piston ring that is fitted to the outside of the piston and slides on an inner surface forming the hole portion of the cylinder, wherein a tapered portion is formed in an end, which is located near a base end of the piston, in the inner surface forming the hole portion of the cylinder.

5 Claims, 4 Drawing Sheets

(51) Int. Cl.

| | |
|---|---|
| ***F04B 39/00*** | (2006.01) |
| ***F04B 39/12*** | (2006.01) |
| ***F04B 35/01*** | (2006.01) |

(56) References Cited

U.S. PATENT DOCUMENTS

| | | | | | |
|---|---|---|---|---|---|
| 3,905,608 | A | | 9/1975 | Olsen et al. | |
| 4,500,267 | A | * | 2/1985 | Birdwell | F04B 15/02 417/342 |
| 4,878,815 | A | | 11/1989 | Stachowiak | |
| 5,493,953 | A | | 2/1996 | Bolthouse et al. | |
| 5,826,491 | A | * | 10/1998 | Steiger | F04B 39/045 267/161 |
| 6,305,265 | B1 | * | 10/2001 | Bingham | F04B 15/08 277/452 |
| 6,544,012 | B1 | | 4/2003 | Blume | |
| 7,329,105 | B2 | * | 2/2008 | Schaake | B60T 17/02 417/244 |
| 2012/0020821 | A1 | | 1/2012 | Asai | |

FOREIGN PATENT DOCUMENTS

| | | | |
|---|---|---|---|
| JP | 10-037857 | | 2/1998 |
| JP | 2008-38783 | A | 2/2008 |
| JP | 2009-013898 | | 1/2009 |
| JP | 2009-62871 | | 3/2009 |
| JP | 2012-067660 | | 4/2012 |

* cited by examiner

RECIPROCATING COMPRESSOR

BACKGROUND OF THE INVENTION

Field of the Invention

The present invention relates to a reciprocating compressor.

Description of the Related Art

Hitherto, there is known a reciprocating compressor that compresses a gas inside a compression chamber by moving a piston in a reciprocating manner.

A reciprocating compressor that is disclosed in JP 2009-62871 A is a compressor that compresses a hydrogen gas to an extreme pressure, and includes a piston (plunger) that is formed in a straight bar shape and a cylinder that includes a hole portion into which the piston is inserted so as to be movable in a reciprocating manner in the axial direction. In the hole portion of the cylinder, an area near the front end of the piston is provided with a compression chamber, and a gas introduced into the compression chamber is compressed when the piston moves toward the front end thereof. In order to prevent the leakage of the gas that exists inside the compression chamber and is compressed to an extreme pressure by the piston, the inner surface portion of the hole portion of the cylinder is provided with a rod packing that slides on the outer peripheral surface of the middle portion of the piston in the axial direction.

SUMMARY OF THE INVENTION

In the compressor that compresses the hydrogen gas to the extreme pressure, there is a case in which a piston ring may be fitted to the outside of the piston so as to slide on the inner surface of the cylinder for the purpose of further reliably preventing the leakage of the gas from the compression chamber through a gap between the inner surface of the hole portion of the cylinder and the outer peripheral surface of the piston. In a case where the piston having the piston ring fitted to the outside thereof needs to be inserted into the hole portion of the cylinder during the assembly of the compressor, the cylinder and the piston ring interfere with each other, so that the compressor assembling operation becomes difficult.

The present invention is made in view of the above-described problems, and an object thereof is to provide a reciprocating compressor capable of easily performing an assembly operation.

In order to attain the above-described object, the present invention provides a reciprocating compressor that compresses a gas, including: a piston; a cylinder that includes a hole portion into which the piston is inserted so as to be movable in the axial direction in a reciprocating manner and includes a compression chamber which is formed in an area of the hole portion with a front end of the piston so that a gas is introduced into the compression chamber; a crank mechanism that drives the piston so that the gas introduced into the compression chamber is compressed by the piston; and a piston ring that is fitted to the outside of the piston and slides on an inner surface of the cylinder forming the hole portion, wherein a tapered portion is formed in an end of the base end side of the piston in the inner surface of the cylinder forming the hole portion.

In the reciprocating compressor, since the tapered portion is formed in the end located near the base end of the piston in the inner surface forming the hole portion of the cylinder, the piston having the piston ring fitted to the outside thereof may be led into the hole portion while the outer peripheral portion of the piston ring is contracted inward in the radial direction by the tapered portion when the piston is inserted into the hole portion of the cylinder during the assembly of the reciprocating compressor. For this reason, even when the outer diameter of the piston ring is larger than the inner diameter of the hole portion before the piston is inserted into the hole portion of the cylinder, the piston having the piston ring fitted to the outside thereof may be smoothly inserted into the hole portion of the cylinder. For this reason, the reciprocating compressor may be easily assembled.

The reciprocating compressor may further include: an annular member that is disposed so as to surround the outside of the piston in the radial direction; and a rod packing that is provided in an inner surface portion of the annular member and slides on an outer peripheral surface of the piston, wherein the cylinder may be disposed so as to contact the annular member in the axial direction of the piston in a separable state.

According to this configuration, the cylinder may be separated from the annular member when the cylinder is separated while being moved with respect to the piston in the axial direction of the piston during the disassembly of the reciprocating compressor. For this reason, the piston ring fitted to the outside of the piston does not interfere with the rod packing provided in the inner surface portion of the annular member when the cylinder is separated from the piston. For this reason, the reciprocating compressor may be easily disassembled.

In this case, the piston may include a piston rod that is connected to the crank mechanism and is inserted through the rod packing and a piston body that is separably coupled to a front end of the piston rod and is formed so that the piston ring is fitted to the outside thereof.

According to this configuration, since the maintenance may be performed by separating the piston body having the piston ring fitted to the outside thereof from the piston rod, the maintenance of the piston body and the piston ring may be easily performed. Further, in this configuration, since the piston body may be separated from the piston rod while the piston rod is inserted through the rod packing during the maintenance of the piston body and the piston ring, the piston body having the piston ring fitted to the outside thereof does not need to be separated through the inside of the rod packing. For this reason, it is possible to prevent the interference between the piston ring and the rod packing during the maintenance of the piston body and the piston ring.

The reciprocating compressor may further include an accommodation portion that accommodates the crank mechanism, and the annular member may be disposed between the accommodation portion and the cylinder and is formed separately from the accommodation portion.

According to this configuration, since the annular member may be formed as a member separated from the accommodation portion, the annular member may be easily manufactured compared to the case where the annular member is integrated with the accommodation portion.

In this case, a fastening portion may be provided which fastens the accommodation portion, the cylinder, and the annular member while the annular member is interposed between the accommodation portion and the cylinder, and the fastening portion may be exposed to the outside of the cylinder.

According to this configuration, the interference between the piston ring and the rod packing may be prevented during the disassembly of the reciprocating compressor while the cylinder, the accommodation portion, and the annular member are reliably fixed to one another by the fastening portion. Specifically, in a case where the inner surface portion of the cylinder is provided with the fastening portion that fastens the annular support member supporting the rod packing to the cylinder, the support member and the rod packing may not be separated from the cylinder unless the cylinder is separated from the piston, and the rod packing interferes with the piston ring fitted to the outside of the piston when the cylinder is separated from the piston. On the contrary, in this configuration, since the fastening portion is exposed to the outside of the cylinder, the cylinder may be separated from the annular member by releasing the fastening operation using the fastening portion from the outside of the cylinder before the cylinder is separated from the piston. For this reason, it is possible to prevent the interference between the piston ring fitted to the outside of the piston and the rod packing provided in the inner surface portion of the annular member when the cylinder is separated from the piston.

In the reciprocating compressor, the crank mechanism may be adapted to be separable from the piston, and may include a connecting rod that transmits power to the piston.

According to this configuration, the maintenance may be performed after the piston is separated from the connecting rod of the crank mechanism when the maintenance of the piston and the piston ring is performed after the cylinder is separated from the piston. For this reason, the maintenance for the piston and the piston ring may be easily performed.

As described above, according to the present invention, it is possible to provide a reciprocating compressor capable of easily performing an assembly operation.

DESCRIPTION OF THE PREFERRED EMBODIMENTS

Figure 1:
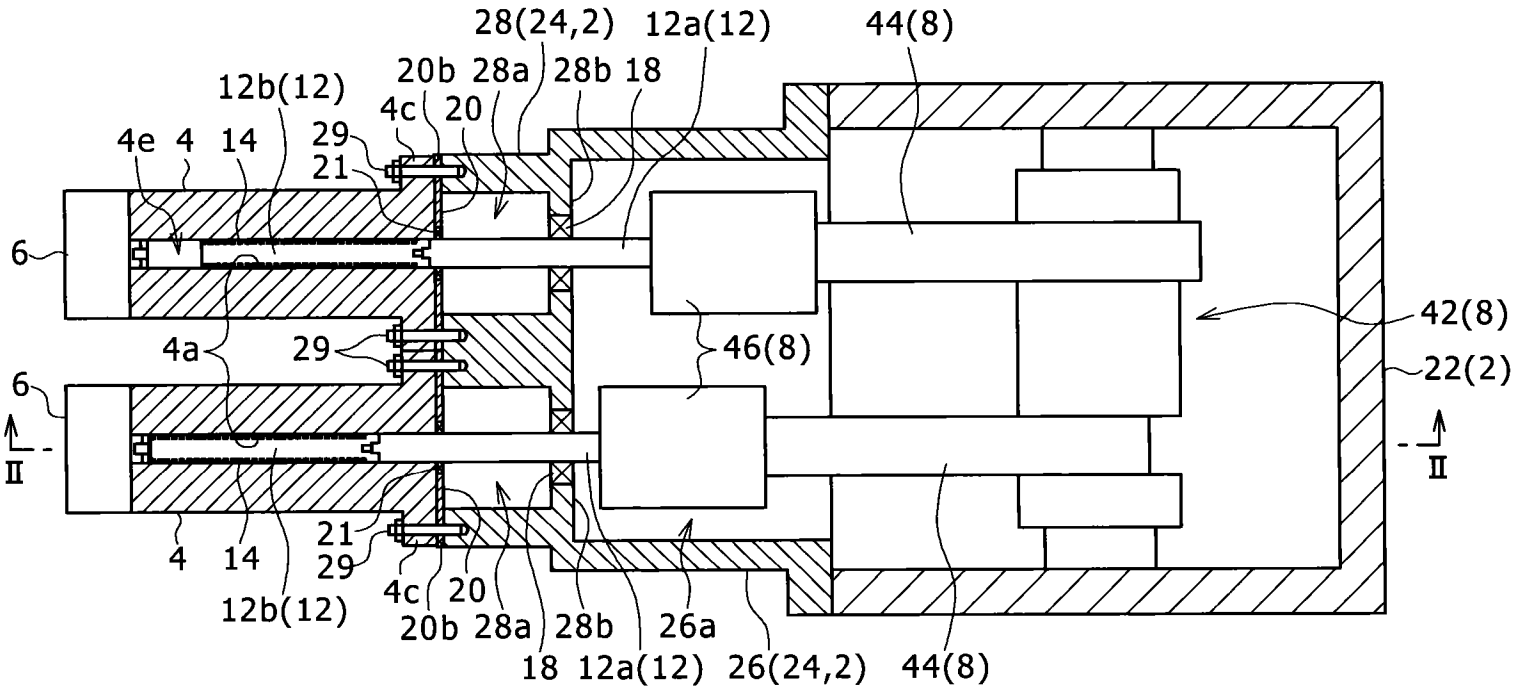
FIG. 1 is a cross-sectional view illustrating a reciprocating compressor according to an embodiment of the present invention.

Hereinafter, preferred embodiments of the present invention will be described by referring to the drawings.

A reciprocating compressor according to an embodiment of the present invention is a compressor that compresses a gas by moving a piston 12 to be described later in a reciprocating manner, and is particularly used to compress a hydrogen gas to an extreme pressure (for example, several tens or several hundreds of MPa) at a hydrogen station that charges a hydrogen gas into a fuel cell vehicle.

As illustrated in FIG. 1, a reciprocating compressor according to this embodiment includes an accommodation portion 2, two cylinders 4, two cylinder heads 6, a crank mechanism 8, a motor (not illustrated), two pistons 12, a plurality of piston rings 14, two oil packings 18, two annular members 20, and two rod packings 21.

The accommodation portion 2 is used to accommodate the crank mechanism 8. The accommodation portion 2 includes a first accommodation portion 22 that is largely opened at one side and is hollow and a second accommodation portion 24 that is attached to the opened side portion of the first accommodation portion 22.

Figure 2:
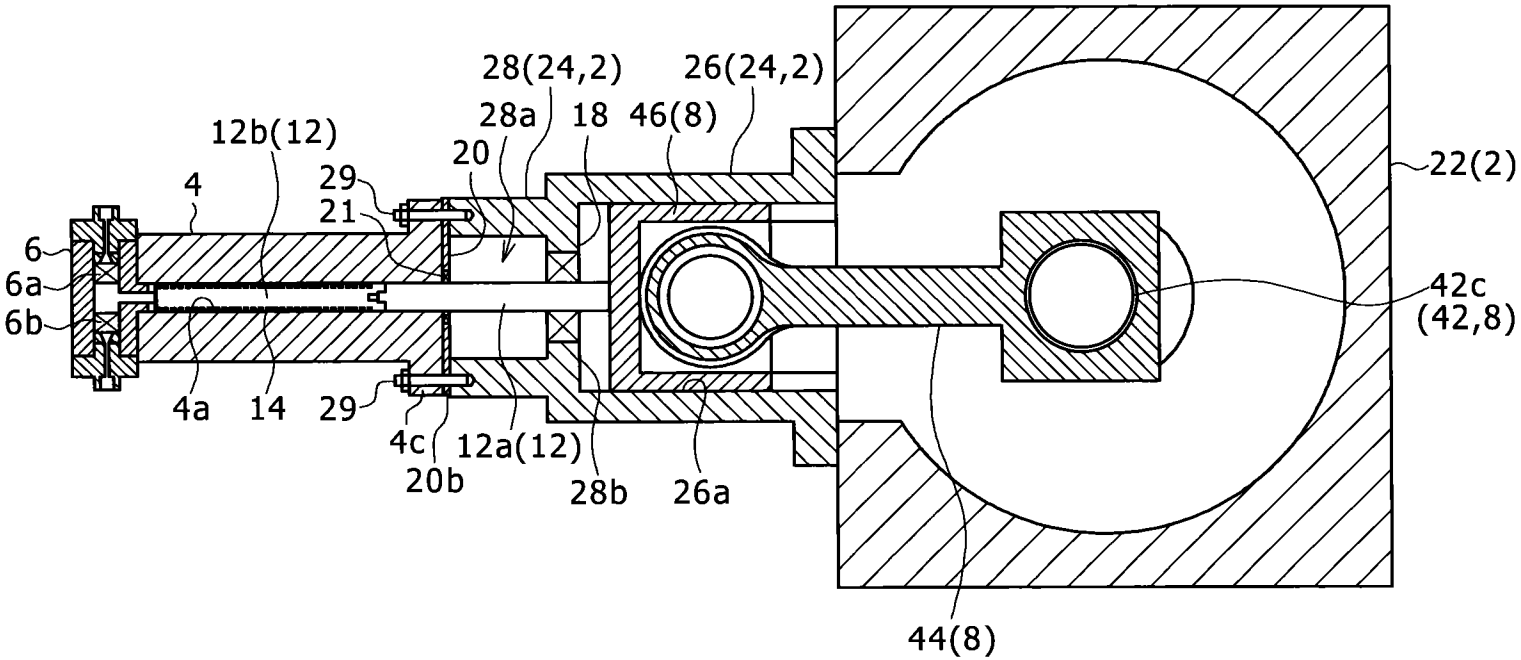
FIG. 2 is a cross-sectional view taken along the line II-II of FIG. 1 of the reciprocating compressor according to the embodiment of the present invention.

The first accommodation portion 22 accommodates a crank shaft 42 to be described later of the crank mechanism 8. As illustrated in FIG. 2, the second accommodation portion 24 protrudes from the opened side portion of the first accommodation portion 22 and is disposed in a posture in which the second accommodation portion 24 extends in the horizontal direction. The second accommodation portion 24 includes a cross guide 26 that is attached to the first accommodation portion 22 and accommodates a cross head 46 to be described later of the crank mechanism 8 and an extension portion 28 that extends from the cross guide 26 toward the opposite side to the first accommodation portion 22.

The cross guide 26 includes therein a head accommodation chamber 26*a* that communicates with the space inside the first accommodation portion 22 and accommodates the cross head 46. The extension portion 28 includes therein two insertion spaces 28*a* (see FIG. 1) that communicate with the head accommodation chamber 26*a* and extends from the head accommodation chamber 26*a* toward the opposite side. The two insertion spaces 28*a* are disposed in parallel, and are respectively opened to the opposite ends of the extension portion 28 with respect to the cross guide 26.

An inner flange 28*b*, which protrudes inward in the radial direction of the insertion space 28*a*, is provided at the end on the head accommodation chamber 26*a* side in the inner surface forming each insertion space 28*a* of the extension portion 28. The two cylinders 4 are respectively attached to the ends opposite to the cross guide 26 (on the crank mechanism 8 side) in the extension portion 28 while being disposed in parallel so that the hole portions 4*a* formed therein communicate with the respective insertion spaces 28*a*. Each cylinder 4 is separably attached to the end opposite to the cross guide 26 in the extension portion 28 through the annular member 20. Specifically, the annular member 20 is formed separately from the cylinder 4 and the extension portion 28, and the end of the cylinder 4 on the extension portion 28 side (on the crank mechanism 8 side) separably contacts the annular member 20 in the axial direction of the piston 12 to be described later. The cylinder 4 includes a cylinder flange portion 4*c* that is formed at the end on the extension portion 28 side. When the cylinder flange portion 4*c*, the end 20*b*, and the end of the extension portion 28 opposite to the cross guide 26 are fastened by a fastening member 29 in a state where the end 20*b* of the annular member 20 is interposed between the cylinder flange portion 4*c* and the end of the extension portion 28 opposite to the cross guide 26, the cylinder 4, the annular member 20, and the extension portion 28 are fixed to one another. The fastening member 29 is exposed to the outside of the cylinder 4. Further, the inner surface portion of each annular member 20 is provided with an annular rod packing 21. The rod packing 21 is supported by the inner surface portion of the annular member 20. The rod packing 21 may be separated from the annular member 20.

Each hole portion 4*a* of the cylinder 4 extends in the axial direction of the cylinder 4. A compression chamber 4*e* (see FIG. 1) into which a gas is introduced is formed in an area facing the front end of the piston 12 inserted as described below in the hole portion 4*a*. Further, a tapered portion 4*d* (see FIGS. 3 and 4) of which the diameter decreases as it goes toward the front end of the piston 12 is formed at the end of the base end of the piston 12 (on the crank mechanism 8 side) in the inner surface forming the hole portion 4*a* of each cylinder 4. The tapered portion 4*d* is formed by chamfering an edge that is formed at the edge of the base end of the piston 12 in the inner surface forming the hole portion 4*a* when the cylinder 4 is processed.

Each cylinder head 6 is attached to the end of the corresponding cylinder 4 opposite to the extension portion 28. As illustrated in FIG. 2, an intake valve 6*a* and a release valve 6*b* are provided inside the cylinder head 6. When a gas is suctioned into the compression chamber 4*e* (see FIG. 1), a gas supplied from the outside of the reciprocating compressor is suctioned into the compression chamber 4*e* through the intake valve 6*a*. Meanwhile, when a gas is released from the compression chamber 4*e*, a compressed gas is released to the outside of the reciprocating compressor through the release valve 6*b*.

As illustrated in FIG. 1, the crank mechanism 8 includes the crank shaft 42, two connecting rods 44, and two cross heads 46. The crank shaft 42 is connected to a motor (not illustrated).

One end of each connecting rod 44 is attached to a corresponding eccentric portion 42*c* (see FIG. 2) of the crank shaft 42, and the other end of each connecting rod 44 is attached to the corresponding cross head 46. Each cross head 46 is accommodated in the head accommodation chamber 26*a* of the cross guide 26 while being movable in a reciprocating manner in the horizontal direction and the direction perpendicular to the axial direction of the crank shaft 42. Each connecting rod 44 and the corresponding cross head 46 convert the eccentric rotation movement of the eccentric portion 42*c* of the crank shaft 42 into the linear reciprocating movement, and transfer the linear reciprocating movement to the piston 12. Accordingly, the crank mechanism 8 drives the piston 12 so that the gas introduced into the compression chamber 4*e* is compressed by the piston 12.

Hereinafter, a structure including the piston 12 and the piston ring 14 according to this embodiment will be described in detail. The reciprocating compressor of this embodiment includes two sets of the structures. Since both structures are the same, only one structure will be representatively described.

The piston 12 is formed in a rod shape, and is inserted into the hole portion 4*a* of the cylinder 4 so as to be movable in a reciprocating manner in the axial direction of the piston 12. The piston 12 includes a piston rod 12*a* that forms a portion from the base end of the piston 12 coupled to the cross head 46 to the middle portion thereof in the axial direction, and a piston body 12*b* that forms a portion from the middle portion of the piston 12 in the axial direction to the front end thereof opposite to the base end.

The base end of the piston rod 12*a* is separably attached to the end of the cross head 46 opposite to the crank shaft 42, and the front end as the end opposite to the base end of the piston rod 12*a* is separably coupled to the base end of the piston body 12*b*. The piston rod 12*a*, the piston body 12*b*, and the cross head 46 are coaxially disposed.

Figure 3:
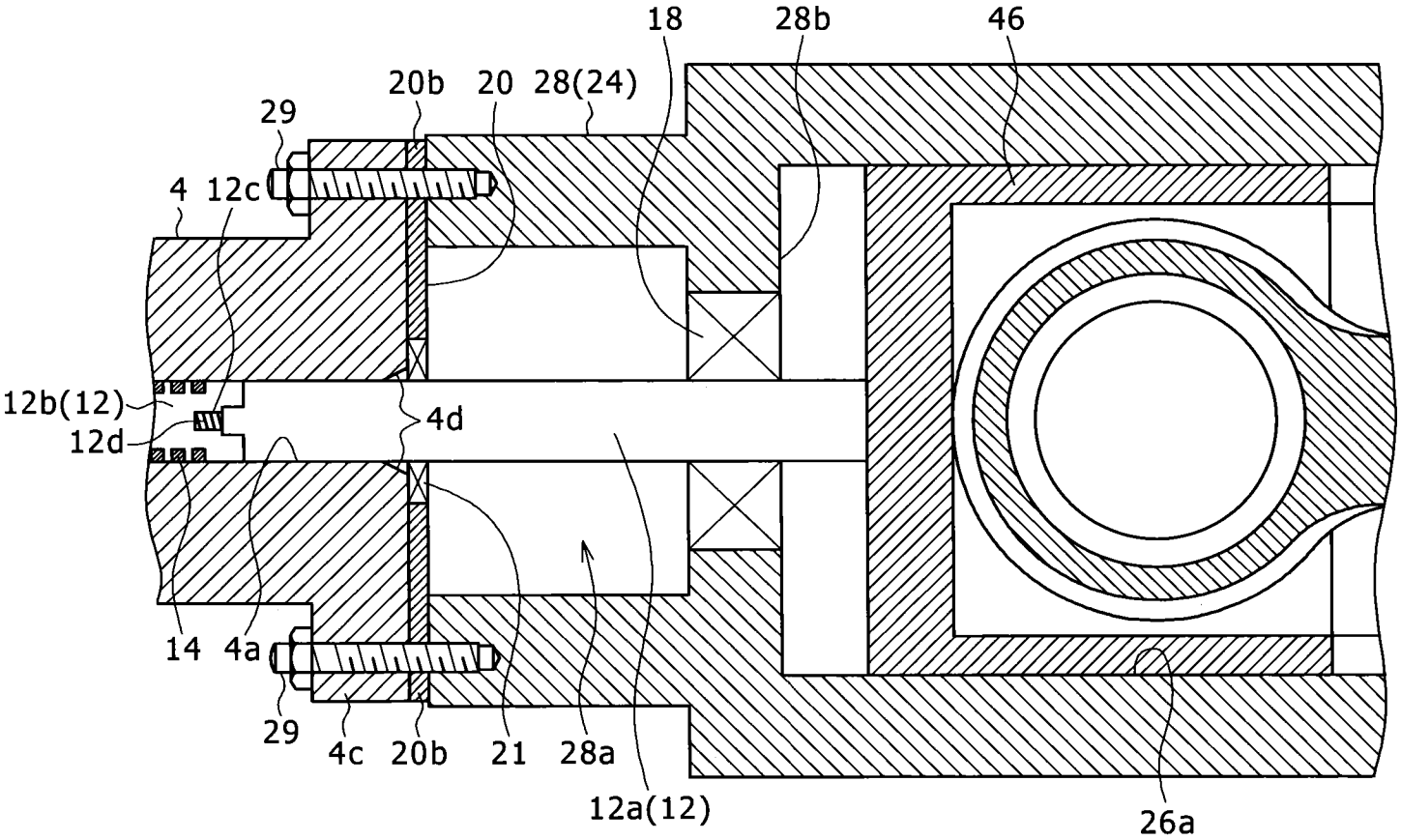
FIG. 3 is a partially enlarged view illustrating an area from a cross guide to a cylinder of the reciprocating compressor illustrated in FIG. 2.
Figure 4:
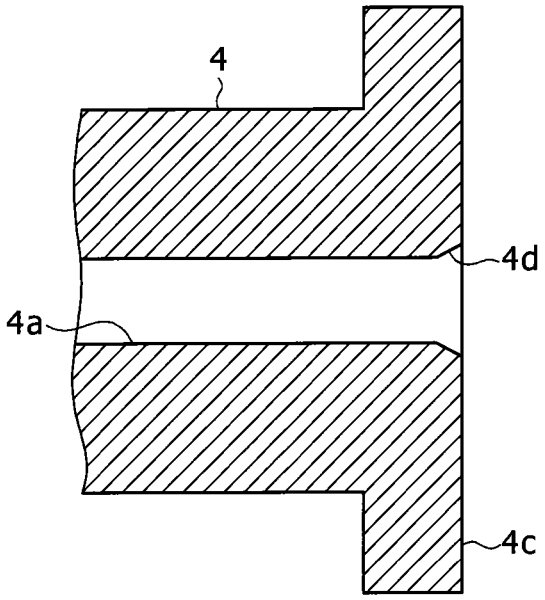
FIG. 4 is a partially enlarged cross-sectional view illustrating the vicinity of a base end of the cylinder of the reciprocating compressor according to the embodiment of the present invention.

As illustrated in FIG. 3, the front end of the piston rod 12*a* is provided with a male screw portion 12*c*, and the base end of the piston body 12*b* is provided with a female screw portion 12*d*. When the male screw portion 12*c* of the piston rod 12*a* is threaded into the female screw portion 12*d* of the piston body 12*b*, the front end of the piston rod 12*a* is coupled to the base end of the piston body 12*b*.

The piston rod 12*a* extends from the cross head 46 toward the opposite side to the crank shaft 42, is inserted through the oil packing 18, and reaches the hole portion 4*a* of the cylinder 4 through the insertion space 28*a* of the extension portion 28. The oil packing 18 prevents the lubricant inside the first accommodation portion 22 (see FIG. 2) from moving toward the hole portion 4*a* with the movement from the head accommodation chamber 26*a* inside the cross guide 26 toward the cylinder 4 of the piston rod 12*a*. The piston rod 12*a* is inserted into the oil packing 18 so as to be slidable in the axial direction of the piston rod 12*a*. Further, the portion near the front end of the piston rod 12*a* is inserted through the annular member 20 and the annular rod packing 21 supported by the annular member 20 so as to be slidable in the axial direction of the piston rod 12*a*. That is, as will be described later, the rod packing 21 slides on the outer peripheral surface of the piston rod 12*a* as the portion on the base end side of the piston 12 in relation to the piston body 12*b* having the piston ring 14 fitted to the outside thereof. The rod packing 21 prevents the leakage of the gas from the hole portion 4*a* of the cylinder 4.

The piston body 12*b* is accommodated inside the hole portion 4*a* of the cylinder 4 so as to be movable in a reciprocating manner in the axial direction. The outer peripheral surface of the piston body 12*b* is provided with a plurality of groove portions that extend in the circumferential direction. The plurality of groove portions is disposed in parallel in the axial direction of the piston body 12*b*. The annular piston ring 14 that prevents the leakage of the gas from the compression chamber 4*e* between the outer peripheral surface of the piston body 12*b* and the inner surface forming the hole portion 4*a* of the cylinder 4 is attached to each groove portion. Since the reciprocating compressor of this embodiment compresses a hydrogen gas to an extreme pressure, a plurality of piston rings 14 are attached to the piston body 12*b* so as to reliably prevent the leakage of the gas. For this reason, the piston body 12*b* has a long length in which the plurality of piston rings 14 may be attached thereto.

The piston ring 14 is formed of an elastic material, and is fitted to the outside of the piston body 12*b*. The piston ring 14 has an outer diameter slightly larger than the inner diameter of the hole portion 4*a* while being separated from the hole portion 4*a* of the cylinder 4. Further, the piston ring 14 slides on the inner surface forming the hole portion 4*a* of the cylinder 4 so that the outer peripheral portion contracts inward in the radial direction while being fitted to the outside of the piston body 12*b* and inserted into the hole portion 4*a* of the cylinder 4. The piston ring 14 is used to prevent the gas compressed into the extreme pressure by the piston 12 from leaking from the compression chamber 4*e* between the outer peripheral surface of the piston body 12*b* and the inner surface forming the hole portion 4*a* of the cylinder 4.

Next, a gas compressing operation using the reciprocating compressor of this embodiment will be described.

In the reciprocating compressor of this embodiment, the eccentric rotation movement of the eccentric portion 42*c* of the crank shaft 42 generated by the rotation of the crank shaft 42 is converted into the linear reciprocating movement by the connecting rod 44 and the cross head 46, and the linear reciprocating movement is transmitted to the piston rod 12*a*. Accordingly, the piston 12 moves in a reciprocating manner in the axial direction.

In a case where the piston 12 moves toward the crank mechanism 8, a gas is suctioned into the compression chamber 4*e* through the intake valve 6*a*. The gas that is suctioned to the compression chamber 4*e* is compressed into an extreme pressure with the movement of the piston 12 toward the opposite side to the crank mechanism 8 (toward the cylinder head 6). The compressed gas is discharged from the compression chamber 4*e* to the outside of the reciprocating compressor through the release valve 6*b*.

Next, a method of assembling the reciprocating compressor according to this embodiment will be described.

In this embodiment, as illustrated in FIG. 1, the crank shaft 42 is disposed inside the first accommodation portion 22. One end of the connecting rod 44 is attached to the eccentric portion 42*c* (see FIG. 2) of the crank shaft 42, and the cross head 46 is attached to the other end of the connecting rod 44. Subsequently, the second accommodation portion 24 is attached to the first accommodation portion 22 while the cross head 46 is accommodated in the head accommodation chamber 26*a* of the cross guide 26.

Next, the piston rod 12*a* is inserted into the insertion space 28*a* from the opening opposite to the head accommodation chamber 26*a*, so that the base end of the piston rod 12*a* is coupled to the cross head 46. The oil packing 18 is disposed inside the second accommodation portion 24 while the piston rod 12*a* is inserted into the oil packing 18.

Next, the annular member 20 supporting the rod packing 21 is temporarily attached to the end of the extension portion 28 of the second accommodation portion 24 opposite to the crank mechanism 8, and the portion near the front end of the piston rod 12*a* is inserted through the rod packing 21.

Next, the female screw portion 12*d* of the base end of the piston body 12*b* in which the plurality of piston rings 14 are fitted to the outside of the piston body is threaded into the male screw portion 12*c* of the front end of the piston rod 12*a*, so that the piston body 12*b* is attached to the piston rod 12*a*.

Next, the cylinder 4 is moved to a position where the base end of the cylinder 4 contacts the annular member 20 while the piston 12 is inserted into the hole portion 4*a* from the end provided with the tapered portion 4*d* of the hole portion 4*a* of the cylinder 4. In a case where the piston 12 is inserted into the hole portion 4*a* of the cylinder 4, the piston ring 14 is led into the hole portion 4*a* while the outer peripheral portion of the piston ring 14 is contracted inward in the radial direction by the tapered portion 4*d*. After the base end of the cylinder 4 is caused to contact the annular member 20, the cylinder flange portion 4*c*, the end 20*b*, and the end of the extension portion 28 are fastened by the fastening member 29 in a state where the end 20*b* of the annular member 20 is interposed between the cylinder flange portion 4*c* and the end of the extension portion 28. Finally, the cylinder head 6 (see FIG. 2) is attached to the front end of the cylinder 4.

As described above, it is desirable that the width of the tapered portion 4*d* in the radial direction of the cylinder 4 be larger than the half of the difference between the inner diameter of the hole portion 4*a* and the outer diameter of the piston ring 14 while the piston ring 14 is separated from the hole portion 4*a* of the cylinder 4, in order to insert the piston 12 into the hole portion 4*a* of the cylinder 4.

Next, a sequence of disassembling the cylinder 4, the piston body 12*b*, the annular member 20, and the accommodation portion 2 according to this embodiment will be described.

First, the cylinder head 6 is separated from the front end of the cylinder 4. Subsequently, the fastening member 29 (see FIG. 3) is separated from the cylinder flange portion 4*c*, the end 20*b* of the annular member 20, and the end of the extension portion 28, so that the fastening the cylinder flange portion 4*c*, the end 20*b*, and the end of the extension portion 28 is released.

Next, the cylinder 4 is separated from the piston 12 by separating the cylinder 4 from the annular member 20 while the annular member 20 and the rod packing 21 are left in the extension portion 28.

Subsequently, the piston body 12*b* is separated from the piston rod 12*a* by releasing the engagement between the female screw portion 12*d* of the piston body 12*b* and the male screw portion 12*c* of the piston rod 12*a*. In a case where the maintenance of the piston ring 14 and the piston body 12*b* is performed, the maintenance is performed after the piston body 12*b* is separated from the piston rod 12*a*. Next, the annular member 20 is separated from the extension portion 28 and the piston rod 12*a* along with the rod packing 21.

As described above, in this embodiment, since the tapered portion 4*d* is formed in the end located on the base end side of the piston 12 in the inner surface forming the hole portion 4*a* of the cylinder 4, when the piston 12 having the piston ring 14 fitted to the outside thereof is inserted into the hole portion 4*a* of the cylinder 4 during the assembly of the reciprocating compressor, the outer peripheral portion of the piston ring 14 may be led into the hole portion 4*a* while being contracted inward in the radial direction by the tapered portion 4*d*. For this reason, even when the outer diameter of the piston ring 14 is larger than the inner diameter of the hole portion 4*a* before the piston is inserted into the hole portion 4*a* of the cylinder 4, the piston 12 having the piston ring 14 fitted to the outside thereof may be smoothly inserted into the hole portion 4*a* of the cylinder 4. For this reason, the reciprocating compressor may be easily assembled.

Further, in this embodiment, since the cylinder 4 is disposed while separably contacting the annular member 20 in the axial direction of the piston 12, the cylinder 4 may be separated from the annular member 20 when the cylinder 4 is separated while being moved toward the front end with respect to the piston 12 in the axial direction of the piston 12 during the disassembly of the reciprocating compressor. For this reason, the piston ring 14 fitted to the outside of the piston 12 does not interfere with the rod packing 21 provided in the inner surface portion of the annular member 20 when the cylinder 4 is separated from the piston 12. For this reason, the reciprocating compressor may be easily disassembled.

Further, in this embodiment, since the piston body 12*b* is separably coupled to the piston rod 12*a*, the maintenance may be performed by separating the piston body 12*b* having the piston ring 14 fitted to the outside thereof from the piston rod 12*a*. For this reason, the maintenance of the piston body 12*b* and the piston ring 14 may be easily performed. Further, in this embodiment, since the piston body 12*b* may be separated from the piston rod 12*a* while the piston rod 12*a* is inserted through the rod packing 21 during the maintenance of the piston body 12*b* and the piston ring 14, there is no need to separate the piston body 12*b* having the piston ring 14 fitted to the outside thereof through the inside of the rod packing 21. For this reason, it is possible to prevent the interference between the piston ring 14 and the rod packing 21 during the maintenance of the piston body 12*b* and the piston ring 14.

Further, in this embodiment, since the female screw portion 12*d* of the piston body 12*b* is threaded into the male screw portion 12*c* of the piston rod 12*a* and then the cylinder 4 is attached to the piston body 12*b* and the piston rod 12*a*, it is possible to attach the cylinder 4 to the piston body 12*b* and the piston rod 12*a* after checking whether the piston body 12*b* is accurately coupled to the piston rod 12*a*.

Further, in this embodiment, in a case where the piston body 12*b* is attached to or separated from the piston rod 12*a*, the female screw portion 12*d* may be attached to or separated from the male screw portion 12*c* by holding the portion near the base end of the piston body 12*b* since the piston body 12*b* and the piston rod 12*a* are not covered by the cylinder 4. In a configuration in which the piston body needs to be attached to or separated from the piston rod while the piston body and the piston rod are inserted into the hole portion of the cylinder, the attachment and separation operation is complex in that the piston body needs to be attached to or separated from the piston rod by gripping the front end of the piston body using a tool. On the contrary, in this embodiment, since the attachment and separation operation may be performed by gripping the portion near the base end of the piston body 12*b*, the workability of the operation of attaching or separating the piston body 12*b* to or from the piston rod 12*a* may be improved.

Further, in a case where the piston body is attached to or separated from the piston rod by holding the front end of the piston body using a tool, there is a need to form a convex portion or a concave portion in the front end of the piston body so that the convex portion or the concave portion is held by a tool. However, in a case where the convex portion is provided, the clearance volume of the front end of the piston increases due to the space formed in the outer periphery of the convex portion. Meanwhile, in a case where the concave portion is provided, the clearance volume of the front end of the piston increases due to the space inside the concave portion. For this reason, the gas compression efficiency using the piston is degraded. On the contrary, in this embodiment, since the piston body 12*b* may be attached to or separated from the piston rod 12*a* by holding the portion near the base end of the piston body 12*b* as described above, there is no need to form the convex portion and the concave portion which are used to be held by a tool in the front end of the piston body 12*b*. For this reason, it is possible to prevent an increase in the clearance volume of the front end of the piston 12, and hence to prevent degradation of the gas compression efficiency using the piston 12.

Further, in this embodiment, since the annular member 20 is formed separately from the accommodation portion 2, the annular member 20 may be easily manufactured compared to the case where the annular member 20 is integrated with the accommodation portion 2.

Further, in this embodiment, it is possible to reliably fix the cylinder 4, the extension portion 28 of the second accommodation portion 24, and the annular member 20 to one another by the fastening member 29. Further, in a case where the fastening portion that fastens the annular member and the cylinder to each other is provided inside the second accommodation portion, the annular member is separated from the piston along with the cylinder when the cylinder is separated from the piston, and hence the rod packing interferes with the piston ring. On the contrary, in this embodiment, since the fastening member 29 that fastens the cylinder 4 and the annular member 20 is exposed to the outside of the cylinder 4, only the cylinder 4 may be separated from the piston 12 by releasing the fastening operation using the fastening member 29. For this reason, the interference between the piston ring 14 and the rod packing 21 may be prevented.

Further, in this embodiment, since the connecting rod 44 of the crank mechanism 8 is separable from the piston 12, the maintenance may be performed after the piston 12 is separated from the connecting rod 44 in a case where the maintenance of the piston 12 and the piston ring 14 is performed after the cylinder 4 is separated from the piston 12. For this reason, the maintenance of the piston 12 and the piston ring 14 may be easily performed.

Furthermore, it is understood that the embodiment disclosed herein is merely an example in every respect and does not limit the present invention. The scope of the present invention is expressed by not the description of the above-described embodiment but the scope of claims. Further, the scope of the present invention includes the meaning equivalent to the scope of claims and all modifications within the scope.

Figure 5:
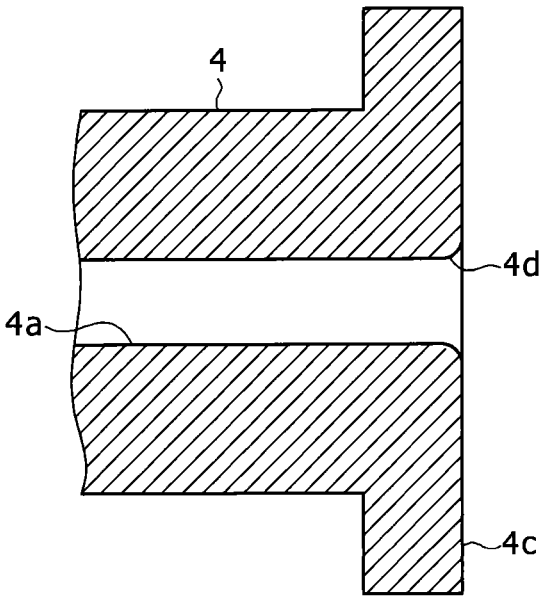
FIG. 5 is a partially enlarged cross-sectional view illustrating the vicinity of a base end of a cylinder of a reciprocating compressor according to a modified example of the embodiment of the present invention.

For example, in the above-described embodiment, the tapered portion 4*d* at the base end of the inner surface of the hole portion 4*a* of the cylinder 4 may be formed in a curved shape as illustrated in FIG. 5.

Further, the structure including the eccentric portion of the crank shaft, the connecting rod, the cross head, the piston, the cross guide, the head accommodation chamber, the insertion space, the cylinder, the cylinder head, the oil packing, the annular member, and the rod packing may not be essentially provided as two sets, and may be provided as only one set.

What is claimed is:

1. A reciprocating compressor that compresses a gas, comprising:

a piston;

a cylinder that includes a hole portion including a base end into which a front end of the piston is inserted such that the piston is reciprocatably movable in the hole portion in an axial direction of the hole portion, wherein the hole portion defines a compression chamber which is formed in an area of the hole portion facing a front end of the piston inserted in the hole portion, wherein a gas is introduced into the compression chamber;

a crank mechanism that drives the piston so that the gas introduced into the compression chamber is compressed by the piston;

a piston ring that is fitted to the outside of the piston and that slides on an inner surface of the cylinder forming the hole portion;

an annular member that is disposed so as to surround the outside of the piston in the radial direction; and a rod packing that is provided in an inner surface portion of the annular member and slides on an outer peripheral surface of the piston, wherein the piston ring is formed of an elastic material and has an outer diameter larger than the diameter of the hole portion when the piston ring is separated from the hole portion, wherein a tapered portion is formed in the inner surface of the cylinder at the base end of the hole portion, wherein a maximum diameter of the tapered portion in a radial direction of the cylinder is larger than the outer diameter of the piston ring when the piston ring is separated from the hole portion, and wherein the tapered portion tapers to a width equal to the diameter of the hole portion, wherein the cylinder is separably and engageably mounted to the annular member in the axial direction, and wherein the annular member does not comprise a taper able to mate with the taper of the tapered portion.

2. The reciprocating compressor according to claim 1, further comprising:

an accommodation portion that accommodates the crank mechanism, wherein the annular member is disposed between the accommodation portion and the cylinder and is formed separately from the accommodation portion.

3. The reciprocating compressor according to claim 2, wherein a fastening portion is provided which fastens the accommodation portion, the cylinder, and the fastening portion is exposed to the outside of the cylinder.

4. The reciprocating compressor according to claim 1, wherein the crank mechanism is separable from the piston, and includes a connecting rod that transmits power to the piston.

5. A reciprocating compressor that compresses a gas, comprising:

a piston;

a cylinder that includes a hole portion including a base end into which a front end of the piston is inserted such that the piston is reciprocatably movable in the hole portion in an axial direction of the hole portion, wherein the hole portion defines a compression chamber which is formed in an area of the hole portion facing a front end of the piston inserted in the hole portion, wherein a gas is introduced into the compression chamber;

a crank mechanism that drives the piston so that the gas introduced into the compression chamber is compressed by the piston;

a piston ring that is fitted to the outside of the piston and that slides on an inner surface of the cylinder forming the hole portion, wherein a tapered portion is formed in the inner surface of the cylinder at the base end of the hole portion;

an annular member that is disposed so as to surround the outside of the piston in the radial direction; and a rod packing that is provided in an inner surface portion of the annular member and slides on an outer peripheral surface of the piston, wherein the cylinder is separably and engageably mounted to the annular member in the axial direction, wherein the piston includes a piston rod that is connected to the crank mechanism and is inserted through a hole in the rod packing, and a piston body that is separably coupled to a front end of the piston rod and is formed so that the piston ring is fitted to the outside thereof, wherein the annular member does not comprise a taper able to mate with the taper of the tapered portion.

* * * * *